United States Patent [19]

Routsis et al.

[11] Patent Number: 5,074,970

[45] Date of Patent: Dec. 24, 1991

[54] METHOD FOR APPLYING AN ABRASIVE LAYER TO TITANIUM ALLOY COMPRESSOR AIRFOILS

[76] Inventors: Kostas Routsis, 67 Huckleberry Rd., East Hartford, Conn. 06108; Joseph J. Parkos, Jr., 60 Bashan Rd., East Haddam, Conn. 06423; Melvin Freling, 40 Old Meadow Rd., West Hartford, Conn. 06117

[21] Appl. No.: 375,230

[22] Filed: Jul. 3, 1989

[51] Int. Cl.[5] ..... C25D 5/14; C25D 5/50; C25D 15/00

[52] U.S. Cl. ..... 205/122; 205/181; 205/226

[58] Field of Search ..... 204/16, 37.1, 40

[56] References Cited

U.S. PATENT DOCUMENTS

| | | | |
|---|---|---|---|
| 3,868,311 | 2/1975 | Durin | 204/33 |
| 3,871,840 | 3/1975 | Wilder et al. | 51/295 |
| 3,945,893 | 3/1976 | Ishimori et al. | 204/16 |
| 4,127,709 | 11/1978 | Ruben | 429/245 |
| 4,148,494 | 4/1979 | Zelahy et al. | 277/53 |
| 4,226,055 | 10/1980 | Komanduri et al. | 51/325 |
| 4,232,995 | 11/1980 | Stalker et al. | 415/172 |
| 4,249,913 | 2/1981 | Johnson et al. | 51/295 |
| 4,390,320 | 6/1983 | Eiswerth | 416/97 |
| 4,404,232 | 9/1983 | Evertz | 427/8 |
| 4,416,739 | 11/1983 | Turner | 204/32 |
| 4,528,074 | 7/1985 | Miyoshita et al. | 204/16 |
| 4,589,823 | 5/1986 | Koffel | 416/92 |
| 4,608,128 | 8/1986 | Farmer et al. | 204/16 |
| 4,608,145 | 8/1986 | Fairbanks | 204/279 |
| 4,787,962 | 11/1988 | Temprano et al. | 204/32.1 |
| 4,802,828 | 2/1989 | Rutz | 416/241 |

*Primary Examiner*—T. M. Tufariello

[57] ABSTRACT

A method for providing an abrasive layer on the surface of a turbine engine component is described. The method includes application of several layers of nickel; one layer includes abrasive particulates. The layer has good bond strength and has a thin cross section, thereby minimizing any effect on the fatigue strength of the component.

2 Claims, 1 Drawing Sheet

METHOD FOR APPLYING AN ABRASIVE LAYER TO TITANIUM ALLOY COMPRESSOR AIRFOILS

TECHNICAL FIELD

This invention relates to the gas turbine engine industry, and in particular, it relates to methods for making components of a gas seal structure for turbine engines. More specifically, the invention relates to methods for depositing a layer having abrasive characteristics onto the surface of titanium alloy blades using electroplating techniques.

BACKGROUND

In the compressor and turbine sections of gas turbine engines, blades rotate about the axis of the engine. The blade tips come in proximity to the inner wall of the engine case, sometimes rubbing the case wall. To prevent excessive wear of the blade tip, abradable seals are sometimes attached to the internal case wall surface, so that when such rubbing does occur, the seals will wear away rather than the blade tips.

To extend the life of blade tips which rub against abradable seals in the turbine section of the engine, abrasive layers are sometimes provided on the blade tip surface. See, for example, U.S. Pat. No. 4,802,828 to Rutz et al., and the patents referenced therein. Rutz mentions several techniques for providing the abrasive layer onto the blade tip, including powder metallurgy techniques, plasma spray techniques, and electroplating techniques. The substrate to which the abrasive layers of the type described by Rutz are high strength superalloys, such as those based upon nickel and cobalt. The thickness of such layers is generally in the range of about 0.4 to about 2.5 millimeters.

The gas turbine engine industry has recognized the usefulness of the aforementioned types of abrasive layers in the turbine section, and now seeks to apply this technology to components used in other sections of the engine. The compressor section is one such section, and new techniques for applying abrasive layers to compressor components are required. This invention describes one such method.

SUMMARY OF THE INVENTION

According to this invention, successive layers of nickel are deposited upon the tip surface of a titanium alloy engine component. The invention comprises the steps of applying a first nickel layer having a thickness of about 12–18 microns directly to the blade tip surface; applying a second nickel layer to the first nickel layer, the second layer being less than about 1 micron in thickness; electroplating a third nickel layer onto the second nickel layer, and while the third layer is being electroplated, submerging the blade tip in a slurry of plating solution and electrically nonconductive abrasive particulates disposed upon a membrane permeable to electric current and plating solution, wherein the particulates in the slurry are entrapped in the third layer by the continued electroplating of nickel; applying a fourth nickel layer onto the third nickel layer, wherein the combined thickness of the third and fourth nickel layers is between about 50 and 95% of the average particulate dimension; and heat treating the plated component.

Components made in conjunction with the invention have excellent abrasive characteristics and are useful in the compressor section of modern gas turbine engines. Other features and advantages of the invention will become apparent in light of the following description of the best mode for carrying out the invention.

BEST MODE FOR CARRYING OUT THE INVENTION

Generally speaking, this invention relates to a method for fabricating a layer having abrasive characteristics to the surface of rotatable components used in the compressor section of turbomachinery. The invention has particular application to the fabrication of abrasive layers on titanium base alloys of the type used in the gas turbine industry.

A key aspect of this invention relates to the combination of a particular set of steps to form the abrasive layer. The combination of steps provides a structure having several layers; each layer is chemically bonded to the layer adjacent to it. Another key aspect of this invention is that the composite layer is relatively thin compared to layers used in the prior art. Thin layers minimize any degradation of high-cycle fatigue properties of the titanium alloy substrate. A third aspect of the invention is that the abrasive particulates within the layer formed by this invention are entrapped within the electroplated metal layer, and extend above the top surface of an electrodeposited matrix. The matrix does not encapsulate the particulates, thereby rendering the particulates significantly more abrasive.

The procedure for applying the abrasive layer onto a titanium based alloy substrate comprises a number of interrelated steps. Since many of the steps involve contacting the substrate with reactive chemicals, surfaces which should be protected from such chemicals are first shielded with wax or other such removable masks. Those surfaces to which the abrasive layer is to be applied must first be cleaned. Useful cleaning media will be known to those skilled in the art. A particularly useful acid etch for cleaning the surfaces to be plated is a solution containing about 5 volume percent of 70% hydrochloric acid and 95 volume percent of 37% hydrofluoric acid, as described in more detail in the copending and commonly assigned patent application to Fornwalt et al. Attorney Docket EH-8592. Once the surface is clean, a thin layer of essentially pure nickel is electroplated thereto The thickness of the first nickel layer is between about 12 and 18 microns, and the heat treated bond strenqth between the nickel layer and the titanium surface is at least about 475 kilograms per square centimeter ($kg/cm^2$).

A second nickel layer (a nickel strike) is then electroplated onto the first nickel layer. The surface of the first layer should be activated using a conventional acid etch prior to application of the second nickel layer. The second nickel layer is applied to a thickness of less than about 1 micron. The purpose of the nickel strike is to encourage the formation of a third nickel layer (applied in a manner described below) having high integrity.

Figure 1:
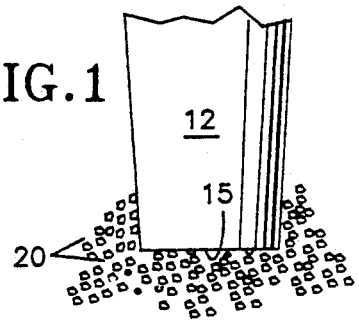
FIG. 1 is a simplified view showing the preferred relation of the blade tip and particulate slurry when practicing this invention.

The third nickel layer is deposited by a method which comprises two related steps. First, the nickel plated titanium component is immersed in a nickel plating solution for a period of time sufficient to begin the electrodeposition of nickel onto the second nickel layer. Once such deposition has begun, the titanium component is submerged in a slurry of plating solution and particulates, preferably within the same plating solution as shown in FIG. 1. In the Figure, the blade is indicated by the reference numeral 12 and the particulates by the reference numeral 20. The blade tip is indicated by the reference numeral 15. The particulates are electrically nonconductive and of a narrow grit size range; such types of particulates include, but are not limited to aluminum oxide, cubic boron nitride, and silicon carbide. Electrically conductive particulates such as SiAlON are not useful in carrying out this invention. The particulates should have an irregular surface texture to maximize abrasive characteristics. While the blade tip is submerged in the slurry, nickel continues to deposit and builds up between the particulates in contact with the blade tip surface, thereby entrapping the particulates in the third nickel layer. Due to the jagged irregular nature of the particulates, they are physically entrapped against the blade tip by the deposition of the third nickel layer. There is no chemical bond formed between the particulates and the blade tip; rather, it is only a physical bond which holds the particulates within the electrodeposited layer of nickel on the blade.

Figure 2:
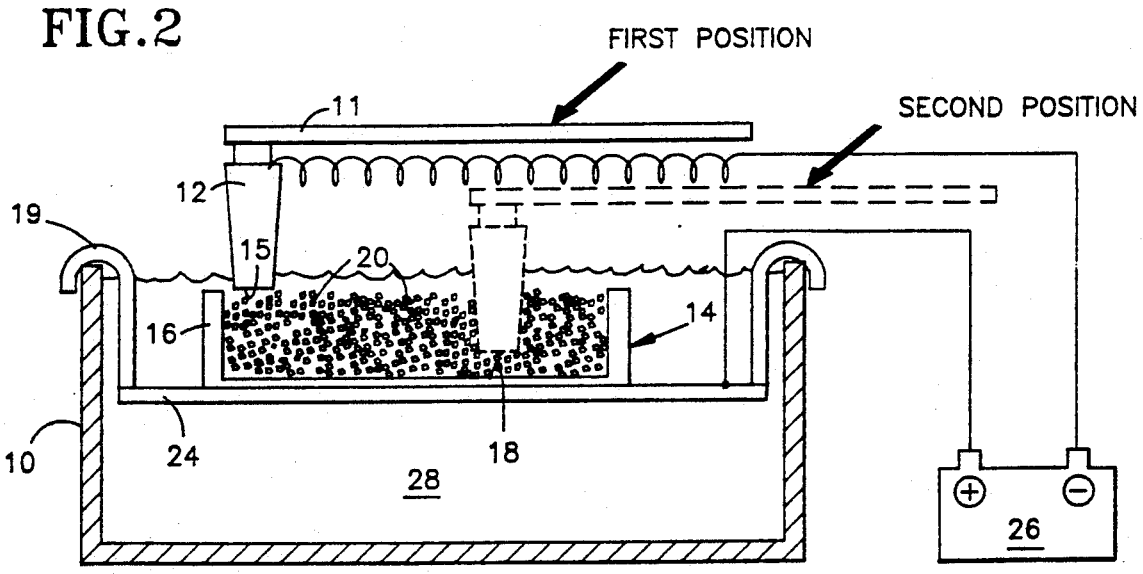
FIG. 2 is a simplified view showing apparatus useful in carrying out this invention.

The preferred apparatus for depositing the third nickel layer onto the blade tip and for entrapping particulates within the third layer is shown in FIG. 2. A plating tank of the type conventional within the industry is indicated by the reference numeral 10. The component 12 to be plated is shown suspended within the tank 10 by a fixture 11. Plating solution is indicated by the reference numeral 13. As is shown in the Figure, the fixture 11 is movable in the vertical direction between a first plating position and a second plating position. A plating box 14 defined by sidewalls 16 and bottom wall 18 is suspended within the tank by support 19. Abrasive particulates 20 reside on the bottom wall 18 of the box 14 due to density effects. The combination of particulates 20 and plating solution 28 form a slurry within the box 14. For reasons which will be made clear below, the bottom wall 18 of the plating box 14 is permeable to the passage of plating solution and electric current. A solid nickel anode 24 is below the bottom wall 18 of the plating box 14. The anode 24 and component 12 are both electrically connected to a conventional power source 26. The plating solution within the tank 10 is indicated by the reference numeral 28.

At the beginning of the process for applying the third nickel layer, the fixture is in the first plating position, as shown in FIG. 2. In this position, the blade tip is positioned above the particulate slurry. After the third nickel layer has started to deposit, the fixture is moved downward, into the second plating position, such that the blade tip is submerged in the particulate slurry, as shown in more detail in FIG. 1. Because current is able to flow through the permeable bottom wall 18, nickel continues to deposit onto the tip surface, and entraps the particulates which are directly contacting the blade tip within the third nickel layer The final thickness of the third nickel layer is less than the average dimension of the particulates entrapped therein, and therefore, the particulates extend through the surface of the third nickel layer. As mentioned above, the particulates are entrapped within the third layer because they are not electrically conductive.

The permeable bottom wall results in more efficient deposition of the third nickel layer. More specifically, in combination with the positioning of an appropriately sized and positioned anode directly beneath the bottom wall, a uniform distribution of current density is achieved which results in a more uniform plated deposit. Furthermore, nickel ions within the plating solution, as well as those produced by dissolution of the anode, are able to readily deposit onto the blade tip.

After a sufficient thickness of the third nickel layer has deposited to secure the particulates in place, the tip is moved out of the slurry and a fourth layer of nickel is electrodeposited over the third layer. Preferably, the blade 12 is simply moved back into the first plating positions (see FIG. 2). The fourth nickel layer more securely attaches the particulates to the component. The combined thickness of the third and fourth nickel layer should be no greater than about 95% of the average dimension of the particulates, but at least greater than about 50% of such dimension. More preferably, the combined thickness of the third and fourth layers is between about ½ and ⅔ of the average particulate dimension.

Abrasive layers applied in the manner described above have been shown to have excellent abradability and are useful in gas seal structures of turbine engines. Their thin cross section adds negligible weight to the blade and does not significantly affect fatigue strength.

As an example of this invention, an abrasive layer was applied to the tip surface of a blade used in the compressor section of a modern gas turbine engine. The blade was a forging whose composition on a weight percent basis was Ti-8Al-1V-1Mo. The blade tip measured about 2.5 centimeters from leading to trailing edge, and the average tip thickness (measured from the concave to convex wall) was about 1 millimeter at its thickest location.

The airfoil portion of the blade was masked with plater's wax so that only the tip portion of the blade was exposed. The exposed tip was wet abrasive blasted with grit silicon dioxide, rinsed in water and immersed in a solution containing (by volume) 95% reagent grade HCl and 5% of 70% HF for about 15 seconds. The blade was rinsed, ultrasonically cleaned for 10 seconds in deionized water, and then anodically etched for about 6 minutes at 1.4 amperes per square meter (ASM) in a solution containing (by volume) 13% HF, 83% glacial acetic acid, balance water. Another rinse operation was performed which was followed by cathodic electrodeposition of nickel in a conventional nickel sulfamate bath for 30 minutes at about 2.8 ASM. The blade was rinsed and heat treated for about four hours at 400° C. in an air circulating furnace. The heat treatment resulted in improved bond strength between the plating and the substrate.

The airfoil portion of the tip was remasked with a combination of a polymer based plater's compound and the tip portion was lightly sanded and then scrubbed with dry and wet pumice. After a very light vapor blast the nickel layer was anodically etched for about 15 seconds at 2.8 ASM in a conventional acid salt solution. The blade was rinsed and further activated by dipping in a 50 volume percent HCl solution. After rinsing again, the blade tip was immersed in a conventional nickel strike solution and cathodically plated at about 1.25 volts for 2 minutes.

The blade was rinsed again and placed in a plating tank containing nickel sulfamate solution. Within the tank was a plating box fabricated from polyvinylchloride plastic. The bottom wall of the box was fabricated from polyethylene mesh. The plating box contained cubic boron nitride particulates, which in combination with the plating solution, produced a slurry about 1–2 centimeters thick on the mesh. The average dimension of the particulates ranged from about 50 to about 100 microns. With the current on, the blade was first immersed in the nickel sulfamate solution and electrodeposition initiated at about 0.8 volts. After about two minutes, the blade was submerged in the slurry and plating continued. After about 15 minutes, the blade was moved slightly within the slurry to dislodge any gas bubbles entrapped on the tip surface and to allow for better grit contact with the surface being plated. Plating continued for an additional 30 minutes. The blade tip was removed from the nickel sulfamate tank. Plating solution and loosely adhered particulates were removed by rinsing the tip in deionized water. The blade tip was then dipped in 50% by volume HCl to maintain the nickel surface active and then was reinserted into a nickel sulfamate solution and cathodically plated for another 45 minutes at 2.8 ASM.

At the completion of the aforementioned procedure, a blade tip having good abrasive properties resulted. The combined thickness of the third and fourth nickel layers was between about ½ and ⅔ of the average dimension of the particulates. That is, the majority of the particulates extended above the surface of the fourth (last) nickel layer, and were not encapsulated by electroplated nickel.

Metallographic examination revealed that the particulates were entrapped in the third and fourth layers; and that there was no separation between any of the individual nickel layers or between the first layer and the titanium alloy substrate.

Although this invention has been shown and described with reference to a preferred embodiment, it should be understood that various changes in form and detail may be made therein without departing from the spirit and scope of that which is claimed.

We claim:

1. A method for providing an abrasive layer on the tip portion of a turbine engine blade made from a titanium base alloy, comprising the steps of:

(a) electroplating a first layer of nickel onto the blade tip, the first nickel being between about 12 and 18 microns thick;

(b) electroplating a second layer of nickel onto the first nickel layer, the second nickel layer being about 1 micron thick or less:

(c) electroplating a third layer of nickel onto the second nickel layer, and then submerging the blade tip in a slurry of electrically nonconductive particulates and plating solution, the slurry present on a membrane permeable to electric current and plating solution, and continuing the electroplating of the third nickel layer;

(d) electroplating a fourth layer of nickel onto the third nickel layer, the combined thickness of the third and fourth nickel layers being less than about 95% of the average dimension of the particulates embedded therein and greater than about 50% of said average dimension; and (e) heat treating the blade at a temperature to cause diffusion between the first nickel layer and the blade tip.

2. The method of claim 1 wherein the particulates are cubic boron nitride having an irregular surface.

* * * * *